US005300394A

United States Patent [19]

Miller et al.

[11] Patent Number: 5,300,394

[45] Date of Patent: Apr. 5, 1994

[54] DISPERSIONS FOR IMAGING SYSTEMS

[75] Inventors: David D. Miller; Mary C. Brick, both of Rochester, N.Y.

[73] Assignee: Eastman Kodak Company, Rochester, N.Y.

[21] Appl. No.: 991,856

[22] Filed: Dec. 16, 1992

[51] Int. Cl.[5] ..... G03C 1/06

[52] U.S. Cl. ..... 430/137; 430/631; 430/635; 430/636; 430/106; 430/570; 430/607; 430/544; 430/543; 430/517; 430/512; 430/551; 430/464

[58] Field of Search ..... 430/631, 635, 636, 137, 430/106, 570, 607, 544, 543, 517, 512, 551, 464

[56] References Cited

U.S. PATENT DOCUMENTS

| | | | |
|---|---|---|---|
| H564 | 1/1989 | Allen et al. | 106/497 |
| 2,728,659 | 12/1955 | Loria et al. | 430/551 |
| 2,768,054 | 10/1956 | Albany et al. | 261/16 |
| 3,126,293 | 3/1964 | McSheehy et al. | 241/15 |
| 3,389,105 | 6/1968 | Bolger et al. | 241/16 |
| 3,459,572 | 8/1969 | Fairlawn et al. | 106/497 |
| 3,884,699 | 5/1975 | Cavallo et al. | 430/502 |
| 3,952,075 | 4/1976 | Nakamura et al. | 252/351 |
| 4,006,025 | 2/1977 | Swank et al. | 430/631 |
| 4,013,232 | 3/1977 | Broughton | 241/14 |
| 4,089,804 | 5/1978 | Falk | 252/355 |
| 4,121,939 | 10/1978 | Adachi et al. | 430/551 |
| 4,171,282 | 10/1979 | Mueller | 252/356 |
| 4,294,916 | 10/1981 | Postle et al. | 430/522 |
| 4,294,917 | 10/1981 | Postle et al. | 430/522 |
| 4,335,201 | 6/1982 | Miller et al. | 430/527 |
| 4,347,308 | 8/1982 | Takeuchi et al. | 430/529 |
| 4,370,254 | 1/1983 | Mitschke et al. | 252/355 |
| 4,385,110 | 5/1983 | Yoneyama et al. | 430/372 |
| 4,474,872 | 10/1984 | Onishi et al. | 430/512 |
| 4,710,230 | 12/1987 | Okoshi et al. | 106/497 |
| 4,861,349 | 8/1989 | Bublik et al. | 51/293 |
| 4,880,169 | 11/1989 | Zander et al. | 241/16 |
| 4,900,653 | 2/1990 | Factor et al. | 430/522 |
| 4,917,309 | 4/1990 | Zander et al. | 241/5 |
| 4,927,744 | 5/1990 | Henzel et al. | 430/566 |
| 4,940,654 | 7/1990 | Diehl et al. | 430/522 |
| 4,946,825 | 8/1990 | Evans et al. | 503/227 |
| 4,948,718 | 8/1990 | Factor et al. | 430/522 |
| 4,988,610 | 1/1991 | Pitt et al. | 430/449 |

FOREIGN PATENT DOCUMENTS

| | | | |
|---|---|---|---|
| 293534A | 12/1988 | European Pat. Off. . | |
| 62-287238 | 12/1987 | Japan . | |
| 2-135437 | 5/1990 | Japan | 430/631 |
| 3-164737 | 7/1991 | Japan | 430/631 |
| 1570362 | 7/1980 | United Kingdom . | |
| 2142840A | 1/1985 | United Kingdom . | |

OTHER PUBLICATIONS

English Language Abstract of DT 2806689, Ciba Geigy AG (Sep. 1978).

T. F. Tadros, "Surfactants, Industrial Applications," *Encyclopedia of Physical Science and Technology*, vol. 13, pp. 579–593 (1987).

RD 34390, Nov. 1992.

RD 308119, Dec. 1989.

*Primary Examiner*—Charles L. Bowers, Jr.
*Assistant Examiner*—John A. McPherson
*Attorney, Agent, or Firm*—Edith A. Rice

[57] ABSTRACT

A solid particle aqueous dispersion of a compound useful in imaging is prepared by milling an aqueous slurry of the compound in the presence of a fluorosurfactant. The resulting dispersion has improved stability to particle growth.

12 Claims, No Drawings

DISPERSIONS FOR IMAGING SYSTEMS

FIELD OF THE INVENTION

This invention relates to imaging technology such as photography and thermal imaging, and in particular, to a method for stabilizing a solid particle dispersion of a substantially water insoluble compound useful in imaging and to the stabilized dispersion.

BACKGROUND OF THE INVENTION

Substantially water-insoluble compounds useful in imaging are generally incorporated into imaging materials as dispersions or emulsions. In many cases, the compound useful in imaging is dissolved in one or more organic solvents, and the resulting oily liquid is then dispersed into an aqueous solution containing, optionally, dispersing aids such as surfactants and/or hydrophilic colloids such as gelatin. Dispersal of the oily liquid into the aqueous medium is accomplished using high shearing rates or high turbulence in devices such as colloid mills, homogenizers, ultrasonicators, or homogenizers.

In the art of dispersion making, the use of organic solvents has traditionally been considered necessary to achieve small particle sizes, to achieve stable dispersions, and to achieve the desired reactivity of the compound useful in imaging. Some compounds that might be useful in unaging cannot be dispersed in the above manner, however, because of their poor solubility in most organic solvents. In other cases, the compound of interest may have sufficient solubility in organic solvents, but it may be desirable to eliminate the use of the organic solvent to reduce the attendant adverse effects, for example, to reduce coated layer thickness, to reduce undesirable interactions of the organic solvent with other materials in the imaging element, to reduce risk of fire or operator exposure in manufacturing, or to improve the sharpness of the resulting image. These and other disadvantages can be overcome by the use of solid particle dispersions in imaging as described in UK Patent No. 1,570,362 to Langen et al, U.S. Pat. No. 4,006,025 to Swank et al, U.S. Pat. No. 4,294,916 to Postle et al, U.S. Pat. No. 4,294,917 to Postle et al, and U.S. Pat. No. 4,940,654 to Diehl et al.

Techniques for making solid particle dispersions are very different from the techniques used to make dispersions of oily liquids. Typically, solid particle dispersions are made by mixing the crystalline solid of interest with an aqueous solution that may contain one or more stabilizers or grinding aids. Particle size reduction is accomplished by subjecting the solid crystals in the slurry to repeated collisions with beads of hard, inorganic milling media, such as sand, spheres of silica, stainless steel, silicon carbide, glass, zirconium, zirconium oxide, alumina, titanium etc., which fracture the crystals. The bead sizes typically range from 0.25 to 3.0 mm in diameter. Ball mills, media mills, attritor mills, jet mills, vibratory mills, etc. are frequently used to accomplish particle size reduction.

Unfortunately, the stabilization of solid particle dispersions is much more difficult than the stabilization of conventional liquid droplet dispersions, since traditional stabilizers such as anionic or nonionic alkyl or aryl surfactants tend to adsorb much more readily to liquid surfaces than to solid surfaces. In fact, the use of such traditional stabilizers in the making of solid particle dispersions frequently results in unwanted particle growth and/or needle-like crystal growth. Such particle growth is undesirable since it reduces the covering power of the compound in the coated layers of an imaging element, while the presence of needle-like crystals results in filter plugging and poor manufacturability. Water soluble polymers such as polyvinylpyrrolidone have been added to solid particle dispersions of sensitizing dyes to reduce particle or crystal growth, as described in U.S. Pat. No. 4,006,025 to Swank et al. However, sensitizing dyes dispersions are not the only solid particle dispersions useful in imaging and it is desirable to provide improved stabilized solid particle dispersions of other water-insoluble compounds useful in imaging.

SUMMARY OF THE INVENTION

It has now been found that the use of a fluorinated surfactant as a grinding aid for the solid particles provides adequate particle size reduction during the grinding step, while stabilizing the dispersion to prevent particle agglomeration, particle growth, and/or crystal growth of the solid particles in the dispersion. The fluorinated surfactant can be fully or partially fluorinated. While such fluorinated surfactants are known in the art of imaging, their use up to now has been as antistats for coating operations, as described in U.S. Pat. No. 4,347,308 to Takeuchi et al, U.S. Pat. No. 4,335,201 to Miller et al, and U.S. Pat. No. 3,884,699 to Cavallo et al or as dispersants for oily liquids, as in U.S. Pat. No. 4,385,110 to Yoneyama et al and Japanese patent application 62-287238 to Konishiroku Photo KK. Their use as grinding aids for solid particle dispersions is not described or suggested.

One aspect of this invention comprises a process for preparing a solid particle aqueous dispersion of a substantially water-insoluble compound useful in imaging, which process comprises milling an aqueous slurry of said compound in the presence of a fluorinated surfactant and then adding the compound to an aqueous medium. The resulting stabilized dispersion can be used in preparing a photographic element.

ADVANTAGEOUS AFFECT OF THE INVENTION

With our invention, dispersions of compounds useful in imaging can be made with vastly improved stability to particle growth.

DETAILED DESCRIPTION OF THE INVENTION

Solid particle dispersions with improved stability for use in imaging can be prepared by employing fluorinated surfactants as a grinding aid for the solid particles. The fluorosurfactant can be partially or fully fluorinated. Preferred fluorinated surfactants can be represented by structure I:

$$(R_f)_n—(A)_m—X \qquad (I)$$

where $R_f$ is a fluorine substituted alkyl, alkenyl, or aryl group, A is a divalent, trivalent, or tetravalent linking group, and X is an $—SO_3M$, $SO_3M$, $(OPO_3)M$ or COOM group, where M is a hydrogen atom or a cation, n is 1, 2, or 3 an m is 0 or 1.

The fluorine substituted alkyl, alkenyl or aryl group can be partially or fully fluorinated. The alkyl or alkenyl group preferably contains 3 to about 18 carbon atoms and the aryl group preferable contains 6 to about 18 carbon atoms.

The linking group A can be for example,

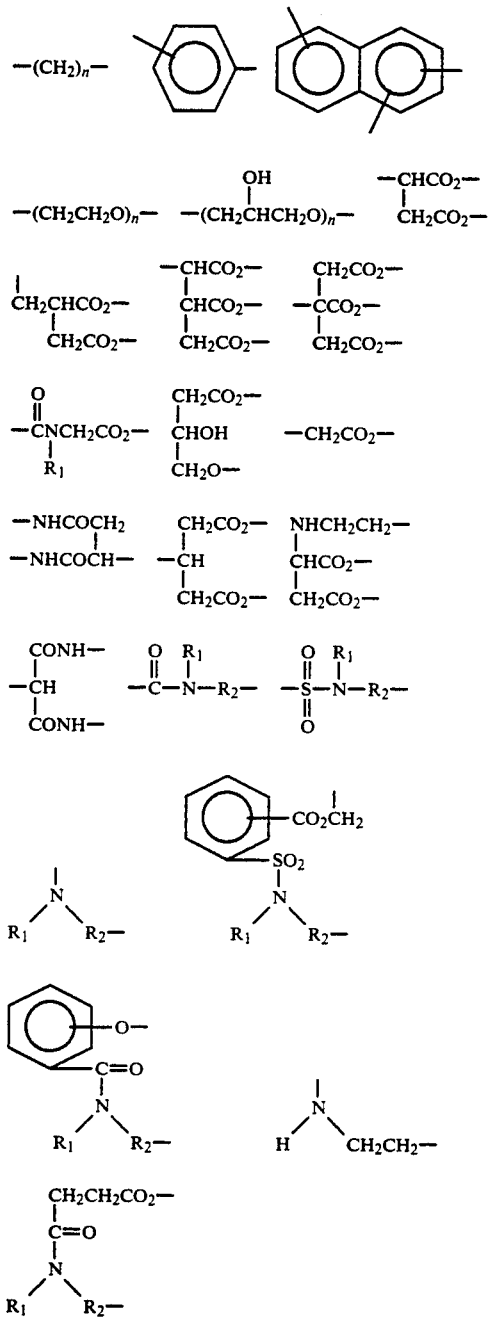

R1 and R2 are independently selected from the group consisting of H, alkyl having 1 to 4 carbon atoms, and hydroxyalkyl having 1 to 4 carbon atoms, and n is 1-50.

The cation M can be for example, an alkali metal, such as sodium or potassium, an ammonium or organic ammonium group such as tetramethylene ammonium, tetraethylene ammonium, tetraethanol ammonium, etc.

Specific examples of fluorinated surfactants which can be utilized in the process of the present invention are given below. It is understood that this list is representative only, and not meant to be exclusive.

F-1:

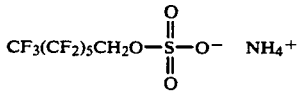

F-2:

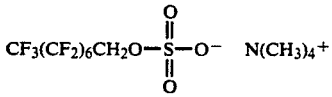

F-3:

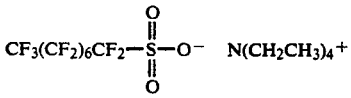

F-4:

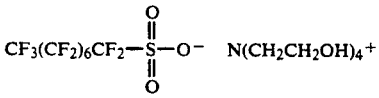

F-5:

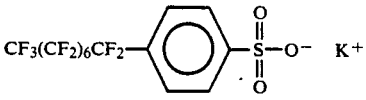

F-6:

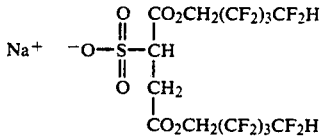

F-7:

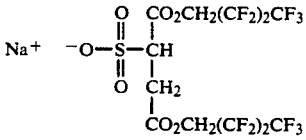

F-8:

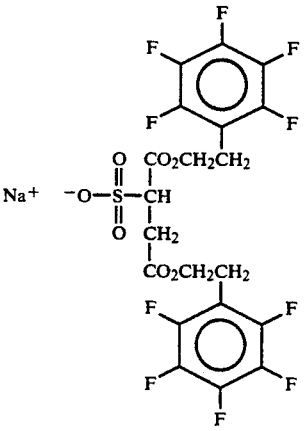

F-9:

-continued

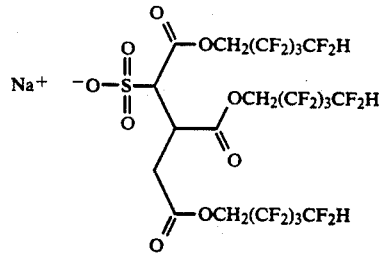

F-10:

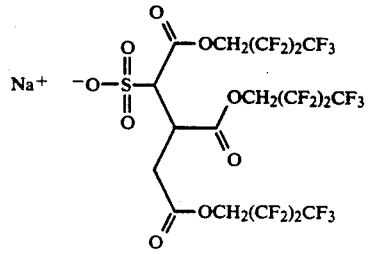

F-11:

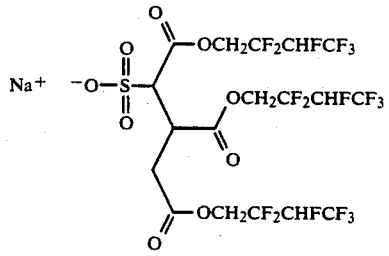

Fluorosurfactants and their preparation are well known in the art and several are commercially available.

The stabilized dispersion of this invention can be prepared by mixing together a fluorinated surfactant and a coarse aqueous slurry of the desired solid compound useful in imaging. The resulting mixture is then loaded into a mill. The amount of fluorinated surfactant used is generally in the range of about 0.1 to about 100% , preferably about 0.5 to about 20%, the percentages being by weight, based on the weight of the compound useful in imaging.

Additional components, for example, additional surfactants, including, but not limited to, other fluorinated surfactants, can be present during the milling step.

The mill used can be for example a ball mill, media mill, attritor mill, jet mill, vibratory mill or the like. These mill is charged with the appropriate milling media such as, for example, beads of silica, silicon nitride, sand, zirconium oxide, alumina, titanium, glass, etc. The bead sizes typically range from 0.25 to 3.0 mm in diameter. The slurry is then added to the mill where repeated collisions of the milling media with the solid crystals in the slurry of the compound useful in imaging result in crystal fracture and consequent particle size reduction.

The resulting dispersion of the compound useful in imaging can then added to an aqueous medium, if desired, for coating onto a photographic support. The aqueous medium preferably contains other components, such as stabilizers and dispersants, for example, additional fluorinated surfactants, anionic, nonionic, zwitterionic, and cationic non-fluorinated surfactants and water-soluble polymers such as polyvinyl pyrrolidone, polyvinyl alcohol, polyethylene oxide, gelatin, copolymers of polyvinyl pyrrolidone and acrylic acid, polyacrylamide, etc.

The resulting solid particle dispersions can be used in the preparation of an imaging element comprising a support, such as paper or film, having coated thereon at least one imaging layer. The dispersion can be coated as a non-imaging layer, such as an interlayer, ultraviolet absorber layer or the like. In other embodiments, the dispersion is mixed with imaging components, such as a silver halide emulsion, and coated as an imaging layer onto the support. If desired, the dispersion can be stored either separately or as a mixture with other components until needed. The preparation of single and multilayer imaging elements is described in Research Disclosure 308119 dated December 1989, the disclosure of which is incorporated herein by reference.

In image forming elements, the solid particle dispersions of this invention can be used as filter dyes to absorb light from different regions of the spectrum, such as red, green, blue, ultraviolet and infrared light. These filter dyes are often required to perform the function of absorbing light during the exposure to the photographic element so as to prevent or at least inhibit light of a certain region of the spectrum from reaching at least one of the radiation sensitive layers of the element. The solid particle filter dye dispersion is typically coated in an interlayer between dye-forming layers, or in an antihalation layer directly above the support. Filter dyes of this type are usually solubilized and removed or at least decolorized during photographic processing. Details of such materials are given in U.S. Pat. No. 4,900,653 to Factor and Diehl, the entire disclosures of which are incorporated herein by reference.

The solid particle dispersions can also function as oxidized developer scavengers which are coated in interlayers to prevent or reduce the reaction of oxidized developer with components in the element. Examples of such materials are given in U.S. Pat. No. 4,927,744 to Henzel and Zengerle, the entire disclosures of which are incorporated herein by reference.

The support of image forming elements of this invention can be coated with a magnetic recording layer as discussed in Research Disclosure 34390 of November 1992, the disclosure of which is incorporated herein by reference.

Illustrative compounds useful in imaging which can be dispersed in aqueous media in accordance with this invention include, for example, couplers, DI(A)R's, sensitizing dyes, filter dyes, UV absorbers, antioxidants, oxidized developer scavengers, trimmer dyes, anti-stain agents, anti-fade agents, silver halide developing agents, toners and pigments for electrophotography, and silver halide emulsion addenda such as sensitizing dyes and antifoggants. A discussion of compounds useful in imaging can be found in above mentioned Research Disclosure 308119 dated December 1989.

Typical preferred compounds useful in imaging that can be used in accordance with this invention are described below. It is understood that this list is representative only, and not meant to be exclusive.

P-1:
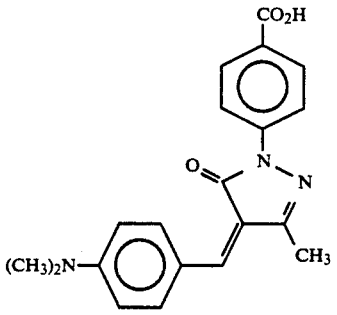
P-2:
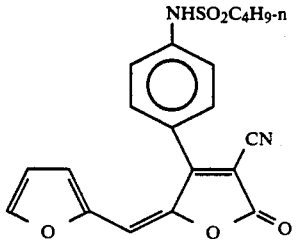
P-3:
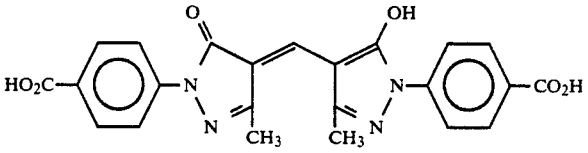
P-4:
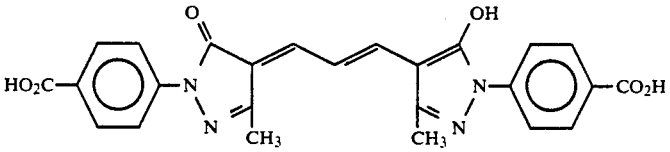
P-5:
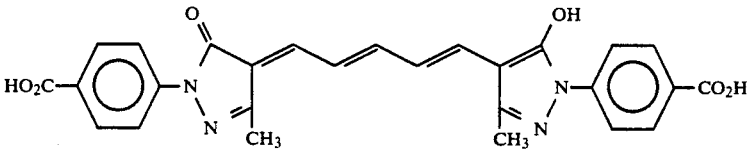
P-6:
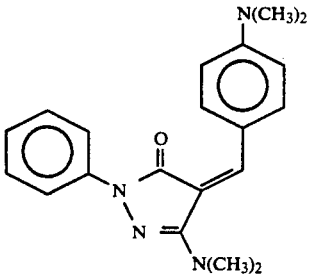
P-7:
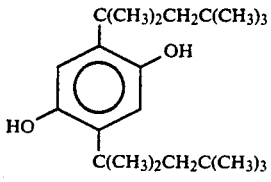

-continued

P-8:

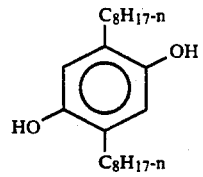

P-9:

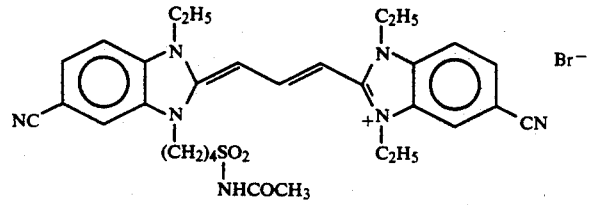

The following examples illustrate the preparation of stabilized solid particle dispersions in accordance with this invention.

EXAMPLE 1

A dispersion of an oxidized developer scavenger useful in photography was made by placing 2.4 g of compound P-7 in a 120 ml glass jar containing 21.36 g of distilled water, 0.24 g fluorosurfactant F-7, and 60 ml of 1.8 mm zirconium oxide beads. The jar was placed on a Sweco vibratory mill for 5 days. The resulting dispersion was mixed with gelatin and water to yield a dispersion having 6% compound P-7 and 9% gelatin. Another similar dispersion was made as above, but fluorosurfactant F-7 was replaced with 0.24 g of fluorosurfactant F-11. A control dispersion was made in the same manner, except that the surfactant Aerosol OT (a conventional surface active agent for use in photographic dispersions) was substituted on an equal-weight basis for fluorosurfactants F-7 and F11, identified above. Both dispersions were examined for particle growth by optical microscopy at 1000× magnification. Results are given in Table I.

TABLE I

| Surfactant | Microscopic Results at t = 0 | Microscopic Results after 24 hours at 45° C. |
|---|---|---|
| Aerosol OT (prior art) | all particles <1 micron | many particles 2–5 microns |
| F-7 | all particles <1 micron | all particles <1 micron |
| F-11 | all particles <1 micron | all particles <1 micron |

Results from Table I show that a stable solid particle dispersion with compound P-7 can be obtained using fluorosurfactants F-7 and F-11, but that the prior art dispersion of P-7 obtained using surfactant Aerosol OT shows particle growth with time.

EXAMPLE 2

A dispersion of a thermal transfer dye was made by placing 2.4 g of compound P-6 in a 120 ml glass jar containing 21.36 g of distilled water, 0.24 g fluorosurfactant F-3 and 60 ml of 1.8 mm zirconium oxide beads. The jar was placed on a Sweco vibratory mill for 5 days. Another dispersion was made in the same manner, except that fluorosurfactant F-7 was substituted on an equal-weight basis for fluorosurfactant F-3. A control dispersion was also made in the same manner, except that the dispersant TX200 (octyl phenoxy polyethylene oxide sulfonate) was substituted on an equal weight basis for fluorosurfactant F-3. After milling, the dispersions were held at ambient temperature as aqueous slurries for 4 weeks. After this period, the particle size of each dispersion was measured by near infrared turbidimetry. Table II gives the mean particle size results in microns of the dispersion of compound P-6 before and after the holding period.

TABLE II

| Surfactant | Mean Particle Size, microns | | |
|---|---|---|---|
| | t = 0 | t = 2 weeks | t = 4 weeks |
| TX200 (prior art) | 0.211 | 0.227 | 0.235 |
| F-7 (present invention) | 0.175 | 0.182 | 0.185 |
| F-3 (present invention) | 0.160 | 0.159 | 0.163 |

Results from Table II show that solid particle dispersions of compound P-6 with fluorosurfactants F-7 and F-3 (present invention) are not only finer in size initially, but also exhibit significantly less particle growth than the prior art dispersion made with dispersant TX200.

EXAMPLE 3

A dispersion of a filter dye, compound P-2, was made by placing 2.4 g of compound P-2 in a 120 ml glass jar containing 21.36 g distilled water, 0.24 g of fluorosurfactant F-11, and 60 ml of 1.8 mm zirconium oxide beads. The jar was placed on a SWECO vibratory mill for 8 days. A control dispersion was made in the same manner, except that the surfactant TX200 was substituted on an equal-weight basis for fluorocarbon surfactant F-11. After milling, the dispersions were were held at 70° C. for 24 hours. After this period, the dispersions were examined for particle growth by optical microscopy at 100OX. Results are given in Table III.

TABLE III

| Surfactant | Microscopic Results at t = 0 | Microscopic Results after 24 hrs. at 70° C. |
|---|---|---|
| TX200 (prior art) | all particles <1 micron | many needle-like particles, 3–5 microns |
| F-11 | all particles <1 micron | all particles <1 micron no needles |

Results from Table III show that a stable solid particle dispersion with compound P-2 and fluorocarbon surfactant F-11 can be obtained, but that the prior art dispersion of P-2 with TX200 develops particle growth as needles with time.

The invention has been described in detail with particular reference to preferred embodiments thereof, but it is to be understood that variations and modifications can be effected within the spirit and scope of the invention.

What is claimed is:

1. A process for preparing a solid particle dispersion of a substantially water-insoluble compound useful in imaging, comprising milling an aqueous slurry of said compound in the presence of a fluorinated surfactant.

2. A process in accordance with claim 1, wherein the fluorinated surfactant is partially fluorinated.

3. A process in accordance with claim 1, wherein the fluorinated surfactant is fully fluorinated.

4. A process in accordance with claim 1, wherein the fluorinated surfactant has the formula:

$$(R_f)_n—(A)_m—X$$

where $R_f$ is a fluorine substituted alkyl, alkenyl, or aryl group of at least 3 carbons, A is a divalent, trivalent, or tetravalent linking group, and X is an—$SO_3M$, $OSO_3M$, or COOM group, where M is a hydrogen atom or a cation, n is 1, 2, or 3 and m is 0 or 1.

5. The process of claim 1, wherein at least one additional surfactant is added to the mill.

6. The process of claim 5, wherein said additional surfactant is a fluorosurfactant.

7. The process of claim 1, which further comprises adding the resulting dispersion to an aqueous medium containing at least one component selected from the group consisting of fluorinated surfactants, anionic, nonionic, zwitterionic or cationic non-fluorinated surfactants, and water soluble polymers.

8. The process of claim 7, wherein said component is polyvinyl pyrrolidone, polyvinyl alcohol, polyethylene oxide, gelatin, a copolymer of polyvinyl pyrrolidone and acrylic acid, or polyacrylamide.

9. The process of claim 1 where the compound useful in imaging is selected from the group consisting of couplers, DI(A)R's, sensitizing dyes, filter dyes, UV absorbers, antioxidants, oxidized developer scavengers, trimmer dyes, anti-stain agents, anti-face agents, silver halide developing agents, toners and pigments for electrophotography.

10. A product produced by the process of claim 1.

11. A photographic element comprising a dispersion produced by the process of claim 1.

12. The process of claim 1, wherein the compound useful in imaging selected from the group consisting of sensitizing dyes and antifoggants.

* * * * *